US011361714B2

(12) United States Patent
Lee et al.

(10) Patent No.: US 11,361,714 B2
(45) Date of Patent: Jun. 14, 2022

(54) DATA DRIVER, DISPLAY APPARATUS INCLUDING THE SAME AND METHOD OF SENSING THRESHOLD VOLTAGE OF PIXEL USING THE SAME

(71) Applicant: SAMSUNG DISPLAY CO., LTD., Yongin-si (KR)

(72) Inventors: Jae-Han Lee, Hwaseong-si (KR); Myeongsu Kim, Hwaseong-si (KR); Wontae Kim, Hwaseong-si (KR); Boyeon Kim, Seoul (KR); Whee-Won Lee, Busan (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/315,784

(22) Filed: May 10, 2021

(65) Prior Publication Data

US 2022/0020329 A1 Jan. 20, 2022

(30) Foreign Application Priority Data

Jul. 15, 2020 (KR) ..... 10-2020-0087706

(51) Int. Cl.
*G09G 3/3258* (2016.01)

(52) U.S. Cl.
CPC ... *G09G 3/3258* (2013.01); *G09G 2300/0833* (2013.01)

(58) Field of Classification Search
CPC ..... G09G 3/3258; G09G 2300/0833
See application file for complete search history.

(56) References Cited

U.S. PATENT DOCUMENTS 8,243,027 B2 * 8/2012 Hotelling ..... G06F 3/04164 345/173
8,334,826 B2 * 12/2012 Min ..... G09G 3/3291 345/82
8,552,960 B2 * 10/2013 Tsuchi ..... G09G 3/3688 345/100
8,860,704 B2 * 10/2014 Lee ..... G09G 3/20 345/211
8,963,817 B2 * 2/2015 Booth, Jr. ..... G06F 3/0421 345/82
9,261,726 B2 * 2/2016 Shi ..... H01L 31/00
10,134,318 B2 * 11/2018 Kim ..... G09G 3/20
(Continued)

FOREIGN PATENT DOCUMENTS

KR 10-0893482 4/2009
KR 10-1381636 3/2014
(Continued)

OTHER PUBLICATIONS

Global Dossier Tranlation of Korean Application 1020110006481, Publication date (Sep. 29, 2017). Inventor: Sang-Gon Lee.*

*Primary Examiner* — Ricardo Osorio
(74) *Attorney, Agent, or Firm* — F. Chau & Associates, LLC

(57) ABSTRACT

A data driver includes a plurality of amplifiers configured to output a plurality of data voltages to a plurality of data lines. The amplifiers are configured to output the data voltages to the corresponding data lines in a writing mode. Only one of the plurality of amplifiers is configured to output a sensing data voltage to the plurality of data lines in a sensing mode.

20 Claims, 9 Drawing Sheets

(56) References Cited

U.S. PATENT DOCUMENTS 10,211,265 B2 * 2/2019 Jeon ..... H01L 27/3227
10,380,942 B2 * 8/2019 An ..... G09G 3/3233
10,930,677 B2 * 2/2021 Bert ..... H01L 29/78693
11,114,028 B2 * 9/2021 Yoon ..... G09G 3/3233
2004/0233226 A1 * 11/2004 Toriumi ..... G09G 3/3648 345/690
2008/0309627 A1 * 12/2008 Hotelling ..... G06F 3/04184 345/173
2009/0066614 A1 * 3/2009 Ishii ..... G09G 3/3275 345/76
2010/0194698 A1 * 8/2010 Hotelling ..... G06F 3/0446 345/173
2012/0182251 A1 * 7/2012 Krah ..... G06F 3/04182 345/174
2012/0268423 A1 * 10/2012 Hotelling ..... G02F 1/13338 345/174
2012/0293478 A1 * 11/2012 Chaji ..... G09G 3/3266 345/212
2014/0028535 A1 * 1/2014 Min ..... G09G 3/3655 345/87
2014/0036168 A1 * 2/2014 Ludwig ..... H01L 27/323 349/12
2015/0061981 A1 * 3/2015 Lee ..... G09G 3/3291 345/77
2015/0332638 A1 * 11/2015 Li ..... G09G 3/3655 345/214
2016/0012798 A1 * 1/2016 Oh ..... G09G 3/325 345/205
2016/0071452 A1 * 3/2016 Nho ..... G09G 3/3614 345/214
2016/0140898 A1 * 5/2016 Hyun ..... G09G 3/3233 345/694
2016/0155381 A1 * 6/2016 Kwon ..... G09G 3/3233 345/215
2016/0163255 A1 * 6/2016 Kim ..... G09G 3/3291 345/212
2016/0370898 A1 * 12/2016 Kobayashi ..... G06F 3/04164
2017/0115798 A1 * 4/2017 Ho ..... G09G 3/3607
2017/0123529 A1 * 5/2017 Ho ..... G06F 3/0416
2018/0075798 A1 * 3/2018 Nho ..... G09G 3/32
2018/0120991 A1 * 5/2018 Kang ..... G09G 3/20
2018/0164950 A1 * 6/2018 Kang ..... G06F 3/0412
2018/0173923 A1 * 6/2018 Lee ..... G06K 9/0004
2018/0366061 A1 * 12/2018 Furukawa ..... G09G 3/30
2019/0051250 A1 * 2/2019 Lee ..... G09G 3/3233
2019/0155429 A1 * 5/2019 Kim ..... G06F 3/042
2019/0180693 A1 * 6/2019 Kim ..... G09G 3/3275
2020/0026383 A1 * 1/2020 Hwang ..... G06F 3/0412
2020/0074931 A1 * 3/2020 Yang ..... G09G 3/3266

FOREIGN PATENT DOCUMENTS

KR 10-1423197 7/2014
KR 10-1529005 6/2015
KR 10-2015-0078358 7/2015
KR 10-1549343 8/2015
KR 10-1597037 2/2016
KR 10-1782818 9/2017

* cited by examiner

DATA DRIVER, DISPLAY APPARATUS INCLUDING THE SAME AND METHOD OF SENSING THRESHOLD VOLTAGE OF PIXEL USING THE SAME

CROSS-REFERENCE

This application claims priority under 35 U.S.C. § 119 to Korean Patent Application No. 10-2020-0087706, filed on Jul. 15, 2020 in the Korean Intellectual Property Office (KIPO), the content of which is herein incorporated by reference in its entirety.

FIELD

The present inventive concept relates to a data driver, a display apparatus including the data driver, and a method of sensing a threshold voltage of a pixel using the display apparatus. More particularly, embodiments of the present inventive concept relate to a data driver outputting a sensing data voltage using only one output amplifier, a display apparatus including the data driver, and a method of sensing a threshold voltage of a pixel using the display apparatus.

DISCUSSION OF RELATED ART

Generally, a display apparatus includes a display panel and a display panel driver. The display panel includes a plurality of gate lines and a plurality of data lines. The display panel driver includes a gate driver and a data driver. The gate driver outputs gate signals to the gate lines. The data driver outputs data voltages to the data lines.

In a writing mode, the data driver may output a data voltage to the display panel. In a sensing mode, the data driver may output a sensing voltage to the display panel. In the sensing mode, the data driver may determine a threshold voltage of a switching element of a pixel by sensing a voltage of the pixel.

The data driver includes a plurality of amplifiers, and an error in the sensed threshold voltage may occur due to a voltage difference between the amplifiers. Due to the error, a display defect may occur in an image displayed on the display panel.

SUMMARY

An embodiment of the present inventive concept provides a data driver for reducing a sensing error of a pixel's threshold voltage.

An embodiment of the present inventive concept provides a display apparatus including the data driver.

An embodiment of the present inventive concept provides a method of sensing a pixel's threshold voltage using the display apparatus.

In an embodiment of a data driver according to the present inventive concept, the data driver may include a plurality of amplifiers configured to output a plurality of data voltages to a plurality of data lines. The amplifiers are configured to output the data voltages to the corresponding data lines in a writing mode. Only one of the plurality of amplifiers is configured to output a sensing data voltage to the plurality of data lines in a sensing mode.

In an embodiment, the data driver may further include a first amplifier connected to a first data line, a switch connected between a second amplifier and a second data line, and at least one channel-connecting switch disposed at a connecting path between the first data line and the second data line.

In an embodiment, the at least one channel-connecting switch may include a first channel-connecting switch connected between the first data line and a common node and a second channel-connecting switch connected between the second data line and the common node.

In an embodiment, the switch may be turned on and the first channel-connecting switch and the second channel-connecting switch may be turned off in the writing mode. The switch may be turned off and the first channel-connecting switch and the second channel-connecting switch may be turned on in the sensing mode.

In an embodiment, the data driver may include a plurality of readout chips. The switch, the first channel-connecting switch and the second channel-connecting switch may be disposed in a first readout chip. The data driver may further include a first chip-connecting line connecting the first readout chip with a second readout chip, and a chip-connecting switch connected between the first chip-connecting line and at least one of the data lines.

In an embodiment, switch may be turned on, and the first channel-connecting switch, the second channel-connecting switch and the chip-connecting switch may be turned off in the writing mode. The switch may be turned off, and the first channel-connecting switch, the second channel-connecting switch and the chip-connecting switch may be turned on in the sensing mode.

In an embodiment, the data driver may further include a sensing amplifier and a sensing switch connected between the sensing amplifier and at least one of the data lines.

In an embodiment further comprising a first switch connected between the first amplifier and the first data line, the switch is a second switch, the first switch and the second switch may be turned on, and the first channel-connecting switch, the second channel-connecting switch and the sensing switch may be turned off in the writing mode. The first switch and the second switch may be turned off and the first channel-connecting switch, the second channel-connecting switch and the sensing switch may be turned on in the second mode.

In an embodiment, the data driver may include a plurality of readout chips. The first switch, the second switch, the first channel-connecting switch and the second channel-connecting switch may be disposed in a first readout chip. The data driver may further include a first chip-connecting line connecting the first readout chip with a second readout chip, a chip-connecting switch connected between the first chip-connecting line and at least one of the data lines, a sensing amplifier and a sensing switch connected between the sensing amplifier and at least one of the data lines.

In an embodiment, the first switch and the second switch may be turned on and the first channel-connecting switch, the second channel-connecting switch and the chip-connecting switch and the sensing switch may be turned off in the writing mode. The first switch and the second switch may be turned off, the first channel-connecting switch, the second channel-connecting switch, the chip-connecting switch and the sensing switch may be turned on in the sensing mode.

In an embodiment of a display apparatus according to the present inventive concept, the display apparatus includes a display panel and a data driver. The display panel is configured to display an image based on input image data. The display panel includes a plurality of data lines and a plurality of pixels connected to the data lines. The data driver includes a plurality of amplifiers configured to output data voltages to the data lines. The amplifiers are configured to output the data voltages to the corresponding data lines in a writing mode. Only one amplifier is configured to output a sensing data voltage to the data lines in a sensing mode.

In an embodiment, the pixel may include a first thin-film transistor configured to apply a first power voltage to a second node in response to a signal at a first node, a second thin-film transistor configured to output the data voltage to the first node in response to a first signal, a third thin-film transistor configured to output a signal at the second node to a sensing node in response to a second signal, a storage capacitor comprising a first end portion connected to the first node and a second end portion connected to the second node, and a light-emitting element comprising a first electrode connected to the second node and a second electrode configured to receive a second power voltage.

In an embodiment, the data driver may further include a first amplifier connected with a first data line, a switch connected between a second amplifier and a second data line, and at least one channel-connecting switch disposed at a connecting path between the first data line and the second data line.

In an embodiment, the at least one channel-connecting switch may include a first channel-connecting switch connected between the first data line and a common node, and a second channel-connecting switch connected between the second data line and the common node.

In an embodiment, the data driver may include a plurality of readout chips. The switch, the first channel-connecting switch and the second channel-connecting switch may be disposed in a first readout chip. The data driver may further include a first chip-connecting line connecting the first readout chip with a second readout chip, and a chip-connecting switch connected between the first chip-connecting line and at least one of the data lines.

In an embodiment, the data driver may further include a sensing amplifier and a sensing switch connected between the sensing amplifier and at least one of the data lines.

In an embodiment, the data driver may include a plurality of readout chips. The switch, the first channel-connecting switch and the second channel-connecting switch may be disposed in a first readout chip. The data driver may further include a first chip-connecting line connecting the first readout chip and a second readout chip, a chip-connecting switch connected between the first chip-connecting line and at least one of the data lines, a sensing amplifier and a sensing switch connected between the sensing amplifier and at least one of the data lines.

In an embodiment of a method of sensing a threshold voltage of a pixel according to the present inventive concept, the method includes outputting a plurality of data voltages to a plurality of corresponding data lines connected to a plurality of pixels using a plurality of amplifiers in a writing mode, outputting a sensing data voltage to the data lines using only one amplifier in a sensing mode and receiving a sensing signal using a plurality of sensing lines connected to the pixels in the sensing mode.

In an embodiment, a first amplifier is connected to a first data line, a switch connected between a second amplifier and a second data line may be turned on, and a channel-connecting switch connected between the first data line and the second data line may be turned off in the writing mode.

In an embodiment, the switch may be turned off and the channel-connecting switch may be turned on in the sensing mode.

According to the data driver, the display apparatus and the method of sensing the threshold voltage of the pixel, the sensing data voltage is output using only one output amplifier in the single readout chip or in the plurality of readout chips in the sensing mode so that the sensing error of the threshold voltage of the pixel may be minimized.

Thus, display defects due to sensing errors of the pixel's threshold voltage may be prevented and the display quality of the display panel may be optimized.

BRIEF DESCRIPTION OF THE DRAWINGS

The above and other features of the present inventive concept may become more apparent by reviewing detailed embodiments thereof with reference to the accompanying drawings, in which.

DETAILED DESCRIPTION

Hereinafter, the present inventive concept will be explained in detail with reference to the accompanying drawings.

Figure 1:
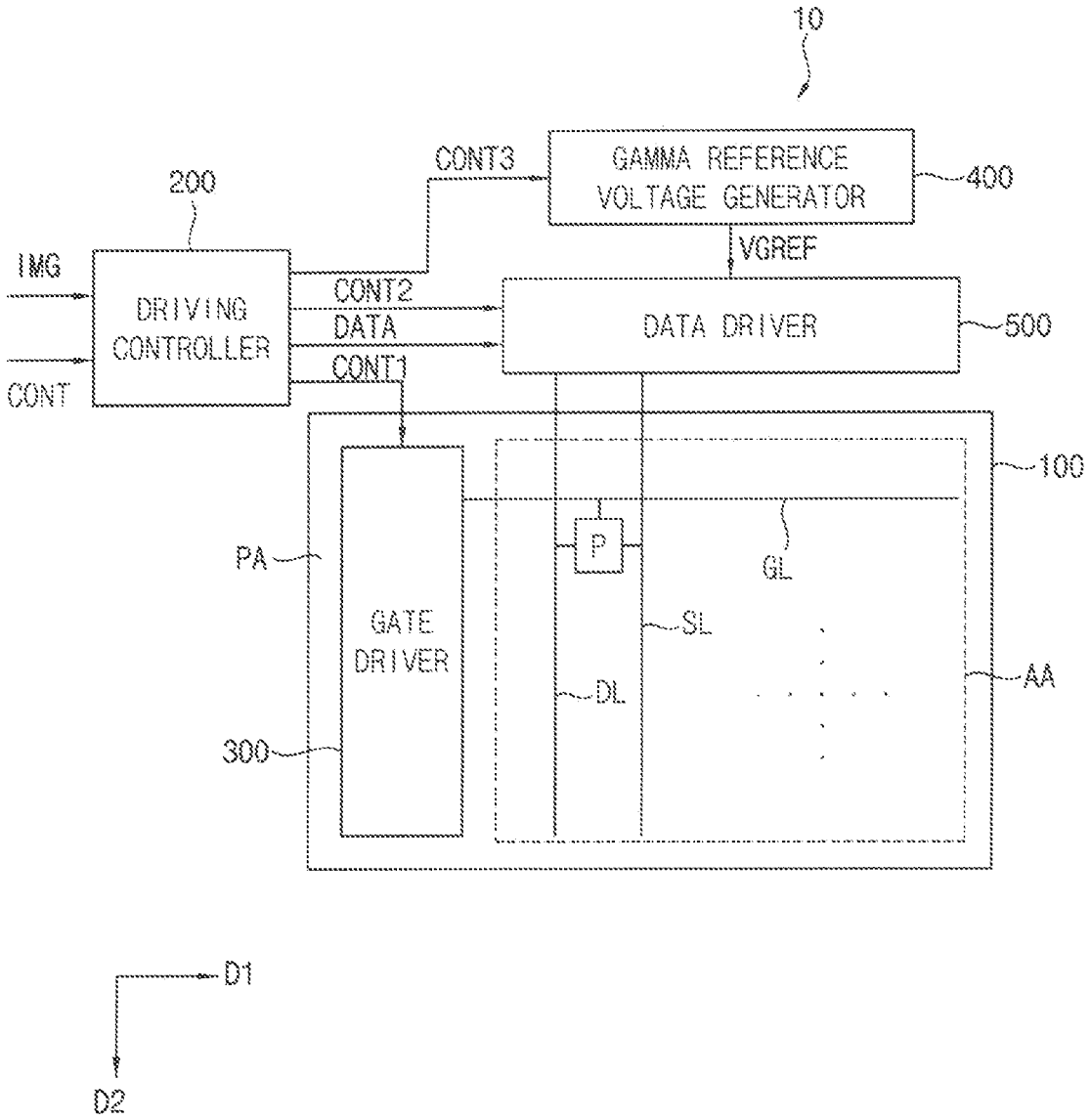
FIG. 1 is a block diagram illustrating a display apparatus according to an embodiment of the present inventive concept.

FIG. 1 shows a display apparatus 10 according to an embodiment of the present inventive concept.

Referring to FIG. 1, the display apparatus 10 includes a display panel 100 and a display panel driver. The display panel driver includes a driving controller 200, a gate driver 300 that may but need not be integrally formed in the display panel 100, a gamma reference voltage generator 400, and a data driver 500.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver (TED).

The display panel 100 has a display region AA on which an image is displayed and a peripheral region PA adjacent to the display region AA.

For example, in the present embodiment, the display panel 100 may be an organic light emitting diode display panel including an organic light emitting diode. Alternatively, the display panel 100 may be a liquid crystal display panel including a liquid crystal layer.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction Dl.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

In the present example embodiment, the gate driver 300 may be integrated on the peripheral region PA of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500, without limitation.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
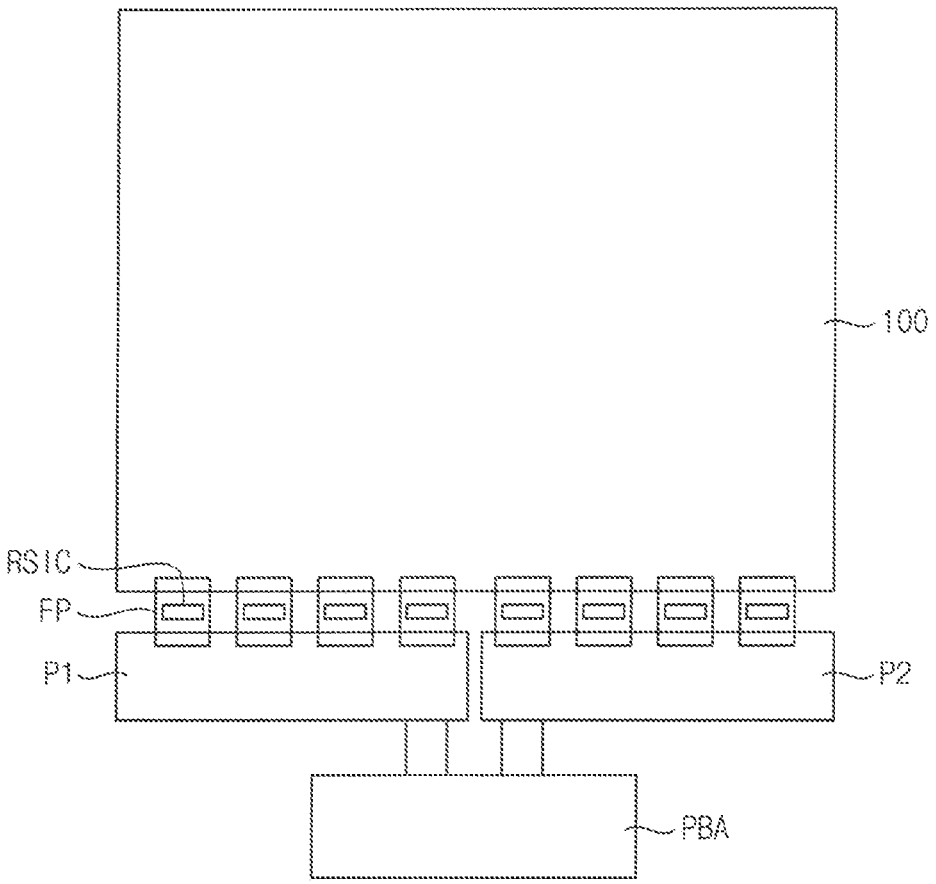
FIG. 2 is a plan view diagram illustrating the display apparatus of FIG. 1.

FIG. 2 shows the display apparatus of FIG. 1 in a plan view.

Referring to FIGS. 1 and 2, the display apparatus may include a printed circuit board assembly PBA, a first printed circuit P1 and a second printed circuit P2. The printed circuit board assembly PBA may be connected to the first printed circuit P1 and the second printed circuit P2. For example, the driving controller 200 may be disposed on the printed circuit board assembly PBA.

The display apparatus may further include a plurality of flexible circuits FP connected to the first printed circuit P1 and the display panel 100. The display apparatus may further include another plurality of flexible circuits FP connected to the second printed circuit P2 and the display panel 100.

Readout chips RSIC of the data driver 500 may be disposed on the flexible circuits FP. Each readout chip RSIC may be an integrated circuit chip.

Figure 3:
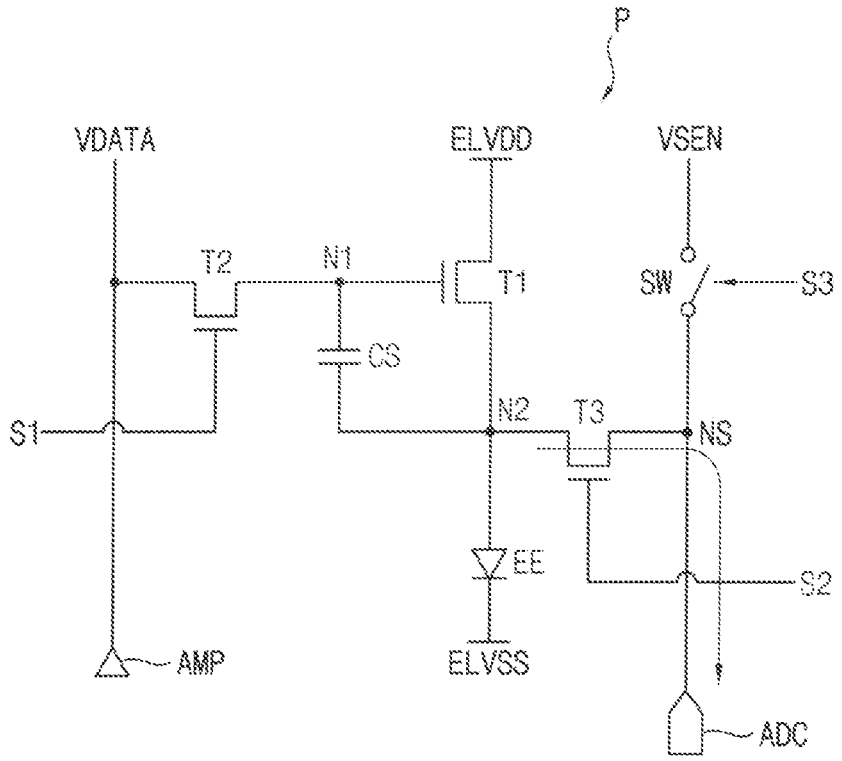
FIG. 3 is a circuit diagram illustrating a pixel of FIG. 1.
Figure 4:
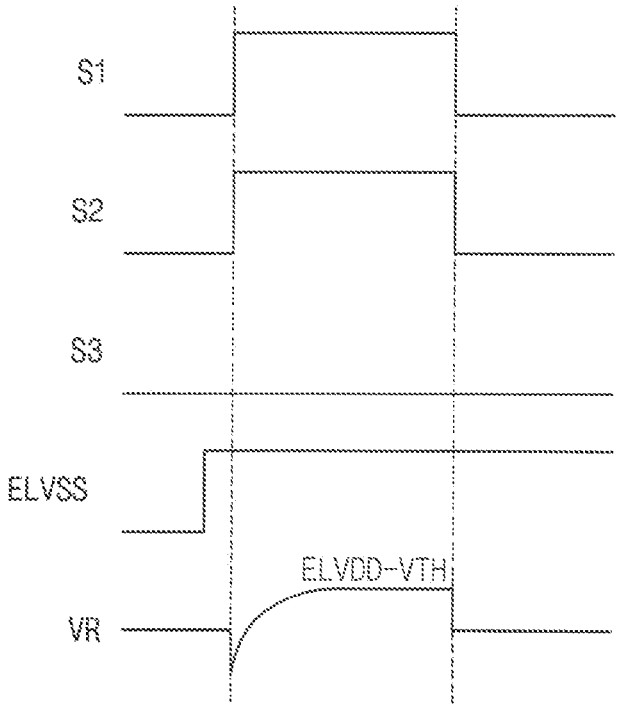
FIG. 4 is a timing diagram illustrating input and output signals of the pixel of FIG. 3 in a sensing mode.

FIG. 3 shows a circuit for the pixel P of FIG. 1. FIG. 4 shows timing of input and output signals for the circuit of the pixel P of FIG. 3 in a sensing mode.

Referring to FIGS. 1 through 4, the pixel P may include a first thin film transistor T1 applying a first power voltage ELVDD to a second node N2 in response to a signal at a first node N1, a second thin film transistor T2 applying the data voltage VDATA to the first node N1 in response to a first signal S1, a third thin film transistor T3 applying a signal at the second node N2 to a sensing node NS in response to a second signal S2, a storage capacitor CS including a first end portion connected to the first node N1 and a second end portion connected to the second node N2, and a light emitting element EE including a first electrode connected to the second node N2 and a second electrode receiving a second power voltage ELVSS.

Herein, the second power voltage ELVSS may be less than the first power voltage ELVDD. For example, the light emitting element may be an organic light emitting diode.

The pixel P may further include a switch SW applying a sensing initialization voltage VSEN to the second node N2 via the third thin film transistor T3. The switch SW may be turned on and turned off based on a third signal S3.

For example, the second signal S2 and the third signal S3 are activated in a sensing initialization step so that the sensing initialization voltage VSEN may be applied to the second node N2.

As shown in FIG. 4, the first signal S1 is activated in a sensing mode so that a data voltage VDATA may be applied to the first node N1 through the second thin film transistor T2. Herein, the data voltage VDATA may be a sensing data voltage applied to sense a threshold voltage of the first thin film transistor.

The first thin film transistor T1 is turned on by the sensing data voltage applied to the first node in the sensing mode, and by the sensing initialization voltage VSEN which has already been applied to the second node in the sensing initialization step.

In addition, the second signal S2 is also activated in the sensing mode so that the third thin film transistor T3 is turned on and the signal VR at the second node N2 may be output to the sensing node NS through the third thin film transistor T3 in the sensing mode.

An analog-to-digital converter ADC is connected to the sensing node NS. The analog-to-digital converter ADC may convert the signal VR at the sensing node NS to a digital sensing signal to sense the threshold voltage of the first thin film transistor T1.

In the sensing mode, the third signal S3 is inactivated so that the sensing initialization voltage VSEN is not applied to the sensing node NS after initialization in the sensing mode. In the sensing mode, the second power voltage ELVSS has a high level so that the pixel P does not emit light.

Figure 5:
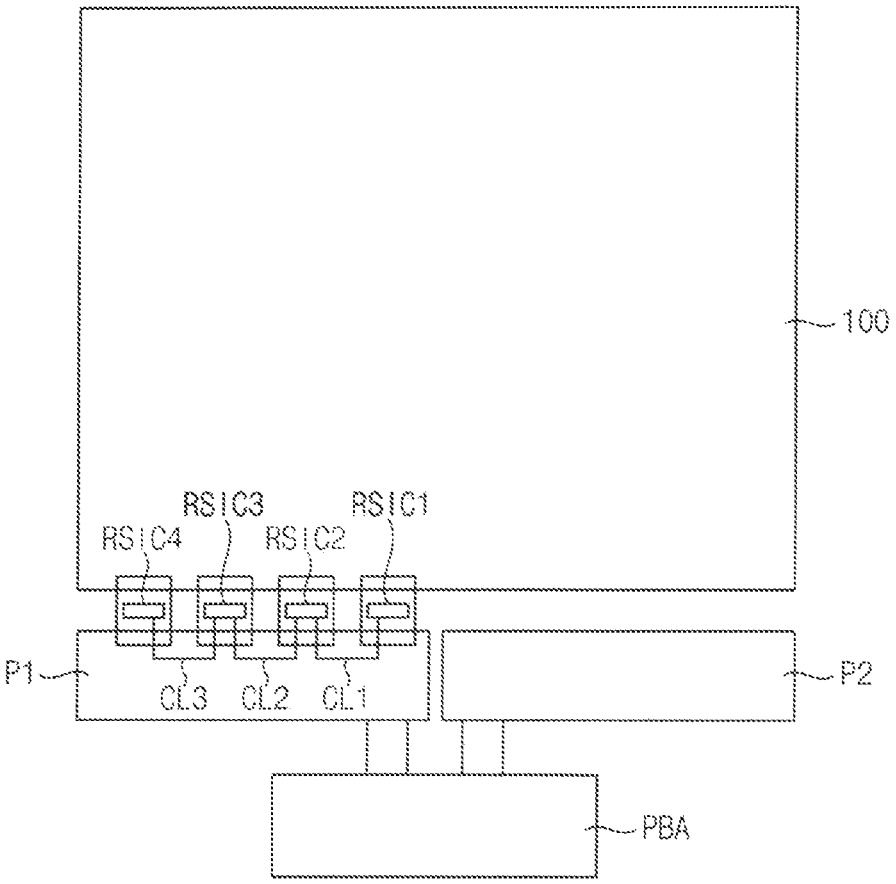
FIG. 5 is a plan view diagram illustrating readout chips of FIG. 2 and chip connecting lines connecting the readout chips.
Figure 6:
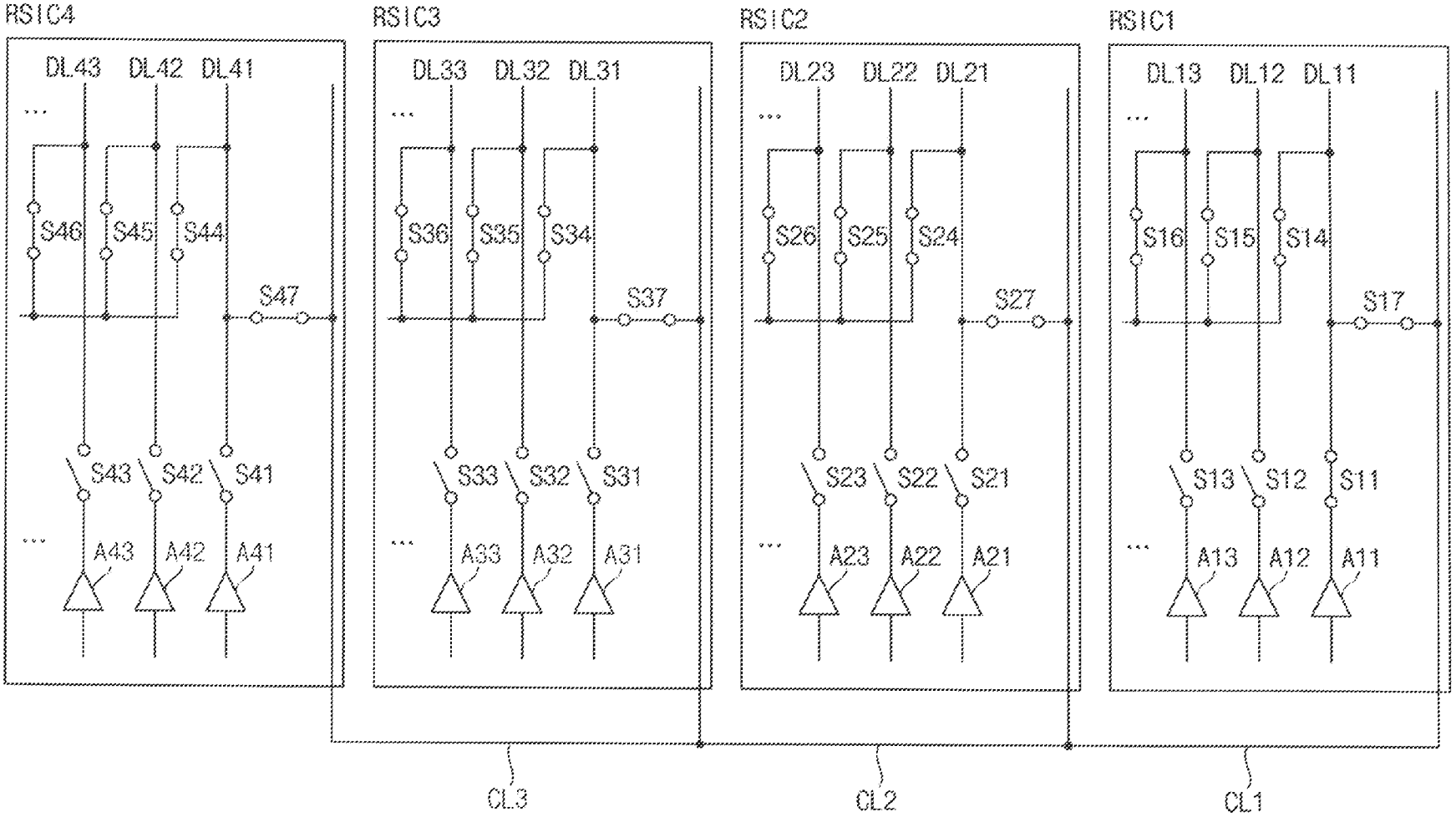
FIG. 6 is a circuit diagram illustrating the readout chips of FIG. 2 in the sensing mode.
Figure 7:
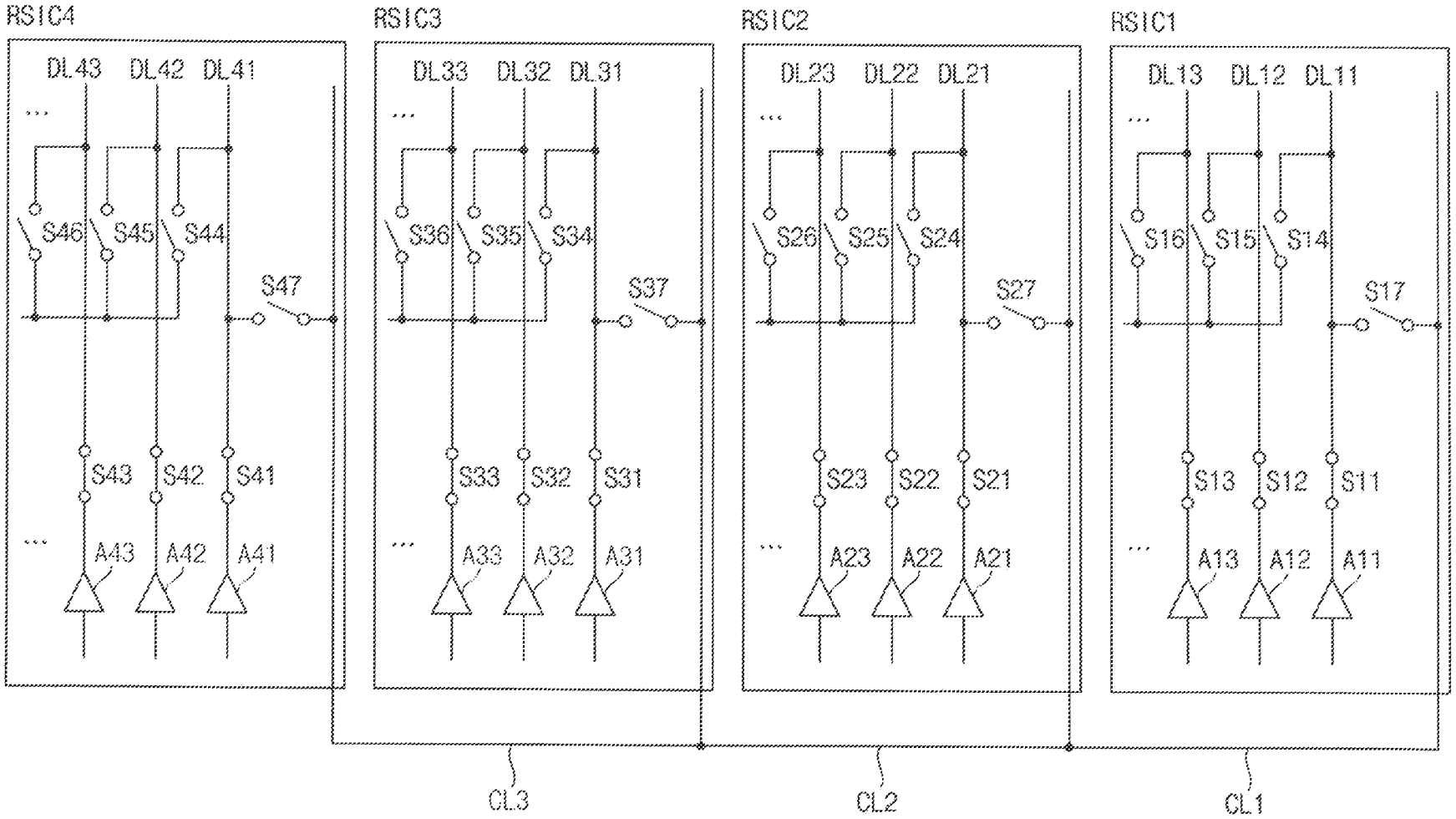
FIG. 7 is a circuit diagram illustrating the readout chips of FIG. 2 in a writing mode.

FIG. 5 shows, in a plan view, readout chips RSIC1, RSIC2, RSIC3 and RSIC4 of FIG. 2, and chip connecting lines CL1, CL2 and CL3 connecting the readout chips RSIC1, RSIC2, RSIC3 and RSIC4. FIG. 6 shows a circuit including the readout chips RSIC1, RSIC2, RSIC3 and RSIC4 of FIG. 2 in the sensing mode. FIG. 7 shows a circuit including the readout chips RSIC1, RSIC2, RSIC3 and RSIC4 of FIG. 2 in a writing mode.

Referring to FIGS. 1 through 7, the data driver 500 may include a plurality of readout chips RSIC1, RSIC2, RSIC3 and RSIC4. The readout chips RSIC1, RSIC2, RSIC3 and RSIC4 may be connected to each other in the sensing mode through the chip connecting lines CL1, CL2 and CL3 and switches S17, S27, S37 and S47, where S17 may be replaced with a conductive connection in an alternate embodiment.

FIG. 5 illustrates a first chip connecting line CL1 connecting a first readout chip RSIC1 with a second readout chip RSIC2, a second chip connecting line CL2 connecting the second readout chip RSIC2 with a third readout chip RSIC3, and a third chip connecting line CL3 connecting the third readout chip RSIC3 with a fourth readout chip RSIC3. As shown in FIG. 6, for example, the first chip connecting line CL1 connecting the first readout chip RSIC1 with the second readout chip RSIC2, the second chip connecting line CL2 connecting the second readout chip RSIC2 with the third readout chip RSIC3, and the third chip connecting line CL3 connecting the third readout chip RSIC3 with a fourth readout chip RSIC3 may be formed as a main connecting line with branches extended from the main connecting line. In the present embodiment, the first through third chip connecting lines CL1, CL2 and CL3 may be respectively formed as shown in FIG. 5 and the first through third chip connecting lines CL1, CL2 and CL3 may be integratedly formed as shown in FIG. 6.

The data driver 500 includes a plurality of amplifiers outputting the data voltages to the data lines. As shown in FIGS. 6 and 7, each of the readout chips RSIC1, RSIC2, RSIC3 and RSIC4 may include the amplifiers outputting the data voltages to the data lines.

The data driver 500 may be operated in a writing mode and in the sensing mode. In the writing mode, the data voltage for displaying an image may be written in the pixels P of the display panel 100. In the sensing mode, the threshold voltage of the pixels P may be sensed from the pixels P.

The sensing mode may be operated in a power on period when the display apparatus starts to turn on, in a black period between active periods when the image is written to the display panel 100 and in a power off period when the display apparatus starts to turn off. The driving controller 200 may compensate the data applied to the pixel P according to the sensed threshold voltage of the pixel and output the compensated data to the data driver 500. The threshold voltage may vary from pixel to pixel due to process distribution and may vary from pixel to pixel according to usage times. If the threshold voltages of the pixels P are not compensated, a difference of display images of the pixels P may occur so that the display quality of the display panel 100 may be deteriorated.

In the writing mode, the amplifiers of the data driver 500 may output the data voltages to the corresponding data lines. In the writing mode, the plurality of amplifiers and the plurality of data lines may be matched one-to-one.

In contrast, in the sensing mode, a single amplifier of the data driver 500 may output the sensing data voltage to the plurality of data lines. In the sensing mode, the single amplifier and the plurality of data lines may be matched one-to-many.

In the present embodiment, for example, the sensing data voltage is applied to all of the data lines corresponding to the four readout chips RSIC1, RSIC2, RSIC3 and RSIC4 using the single amplifier A11 of the data driver 500 in the sensing mode. In an alternate embodiment, the single amplifier used in the sensing mode may be different from all of the amplifiers used in the writing mode.

Alternatively, for example, the sensing data voltage may be applied to all of the data lines corresponding to eight readout chips disposed at the first printed circuit P1 and the second printed circuit P2 in FIG. 2 using the single amplifier A11 of the data driver 500.

As shown in FIG. 6, the first readout chip RSIC1 may include a first amplifier A11, a second amplifier A12 and a third amplifier A13. Although the three amplifiers A11, A12 and A13 are illustrated in FIG. 6 for convenience of explanation, the first readout chip RSIC1 may further include many amplifiers in addition to the three amplifiers A11, A12 and A13. For example, when the number of channels of the first readout chip RSIC1 is 960, the readout chip RSIC1 may include 960 amplifiers.

The first readout chip RSIC1 may further include a first switch S11 connected between the first amplifier A11 and a first data line DL11, a second switch S12 connected between the second amplifier A12 and a second data line DL12 and a third switch S13 connected between the third amplifier A13 and a third data line DL13. In an alternate embodiment, the first switch S11 may be replaced with a conductive connection.

In addition, the first readout chip RSIC1 may further include at least one channel connecting switch disposed at a connecting path between the first data line DL11 and the second data line DL12. For example, the first readout chip RSIC1 may include a first channel connecting switch S14 connected between the first data line DL11 and a common node and a second channel connecting switch S15 connected between the second data line DL12 and the common node.

In addition, the first readout chip RSIC1 may further include at least one channel connecting switch disposed at a connecting path between the second data line DL12 and the third data line DL13. For example, the first readout chip RSIC1 may include the second channel connecting switch S15 connected between the second data line DL12 and the common node and a third channel connecting switch S16 connected between the third data line DL13 and the common node.

In addition, the first readout chip RSIC1 may further include a first chip connecting switch S17 disposed between the first chip connecting line CL1, which connects the first readout chip RSIC1 and the second readout chip RSIC2, and at least one (e.g., DL11) of the data lines.

In the present embodiment, in the writing mode, the first switch S11, the second switch S12 and the third switch S13 may be turned on and the first channel connecting switch S14, the second channel connecting switch S15, the third channel connecting switch S16 and the chip connecting switch S17 may be turned off.

Thus, in the writing mode, the amplifiers A11 through A13 and the data lines DL11 through DL13 form a one-to-one connection so that the data voltages are output to the data lines DL11 through DL13 by the amplifiers A11 through A13.

In contrast, in the sensing mode, the first switch S11 may be turned on; the second switch S12 and the third switch S13 may be turned off; the first channel connecting switch S14, the second channel connecting switch S15, the third channel connecting switch S16 and the chip connecting switch S17 may be turned on.

Thus, in the sensing mode, the first amplifier A11 and the data lines DL11 through DL13 form a one-to-many connection so that substantially the same sensing data voltage is applied to the data lines DL11 through DL13 by only the first amplifier A11.

In addition, the sensing data voltage of the first amplifier A11 of the first readout chip RSIC1 may be transmitted to the second readout chip RSIC2 through the chip connecting switch S17 and the first chip connecting line CL1.

Therefore, in the sensing mode, the sensing data voltage may be applied to data lines DL21 through DL23 of the second readout chip RSIC2 by only the first amplifier A11.

In the same way, in the sensing mode, the sensing data voltage may be output to data lines DL31 through DL33 of the third readout chip RSIC3 and data lines DL41 through DL43 of the fourth readout chip RSIC4 by only the first amplifier A11.

The second readout chip RSIC2 may include a fourth amplifier A21, a fifth amplifier A22 and a sixth amplifier A23. The second readout chip RSIC2 may further include a fourth switch S21 connected between the fourth amplifier A21 and a fourth data line DL21, a fifth switch S22 connected between the fifth amplifier A22 and a fifth data line DL22 and a sixth switch S23 connected between the sixth amplifier A23 and a sixth data line DL23.

In addition, the second readout chip RSIC2 may further include channel connecting switches S24, S25 and S26 disposed at connecting paths between the fourth through sixth data lines DL21 through DL23.

In addition, the second readout chip RSIC2 may further include a second chip connecting switch S27 disposed between the second chip connecting line CL2, which connects the second readout chip RSIC2 and the third readout chip RSIC3, and at least one (e.g., DL21) of the data lines.

The third readout chip RSIC3 may include a seventh amplifier A31, an eighth amplifier A32 and a ninth amplifier A33. The third readout chip RSIC3 may further include a seventh switch S31 connected between the seventh amplifier A31 and a seventh data line DL31, an eighth switch S32 connected between the eighth amplifier A32 and an eighth data line DL32 and a ninth switch S33 connected between the ninth amplifier A33 and a ninth data line DL33.

In addition, the third readout chip RSIC3 may further include channel connecting switches S34, S35 and S36 disposed at connecting paths between the seventh through ninth data lines DL31 through DL33.

In addition, the third readout chip RSIC3 may further include a third chip connecting switch S37 disposed between the third chip connecting line CL3, which connects the third readout chip RSIC3 and the fourth readout chip RSIC4, and at least one (e.g., DL31) of the data lines.

The fourth readout chip RSIC4 may include a tenth amplifier A41, an eleventh amplifier A42 and a twelfth amplifier A43. The fourth readout chip RSIC4 may further include a tenth switch S41 connected between the tenth amplifier A41 and a tenth data line DL41, an eleventh switch S42 connected between the eleventh amplifier A42 and an eleventh data line DL42 and a twelfth switch S43 connected between the twelfth amplifier A43 and a twelfth data line DL43.

In addition, the fourth readout chip RSIC4 may further include channel connecting switches S44, S45 and S46 disposed at connecting paths between the tenth through twelfth data lines DL41 through DL43.

In addition, the fourth readout chip RSIC4 may further include a fourth chip connecting switch S47 disposed between the third chip connecting line CL3 and at least one (e.g., DL41) of the data lines.

According to the present embodiment, the sensing data voltage is output using only one output amplifier A11 in the plurality of readout chips RSIC1 through RSIC4 in the sensing mode so that the sensing error of the threshold voltage of the pixel P may be reduced.

Thus, display defects due to sensing errors of the threshold voltage of the pixel P may be prevented and the display quality of the display panel may be optimized.

Figure 8:
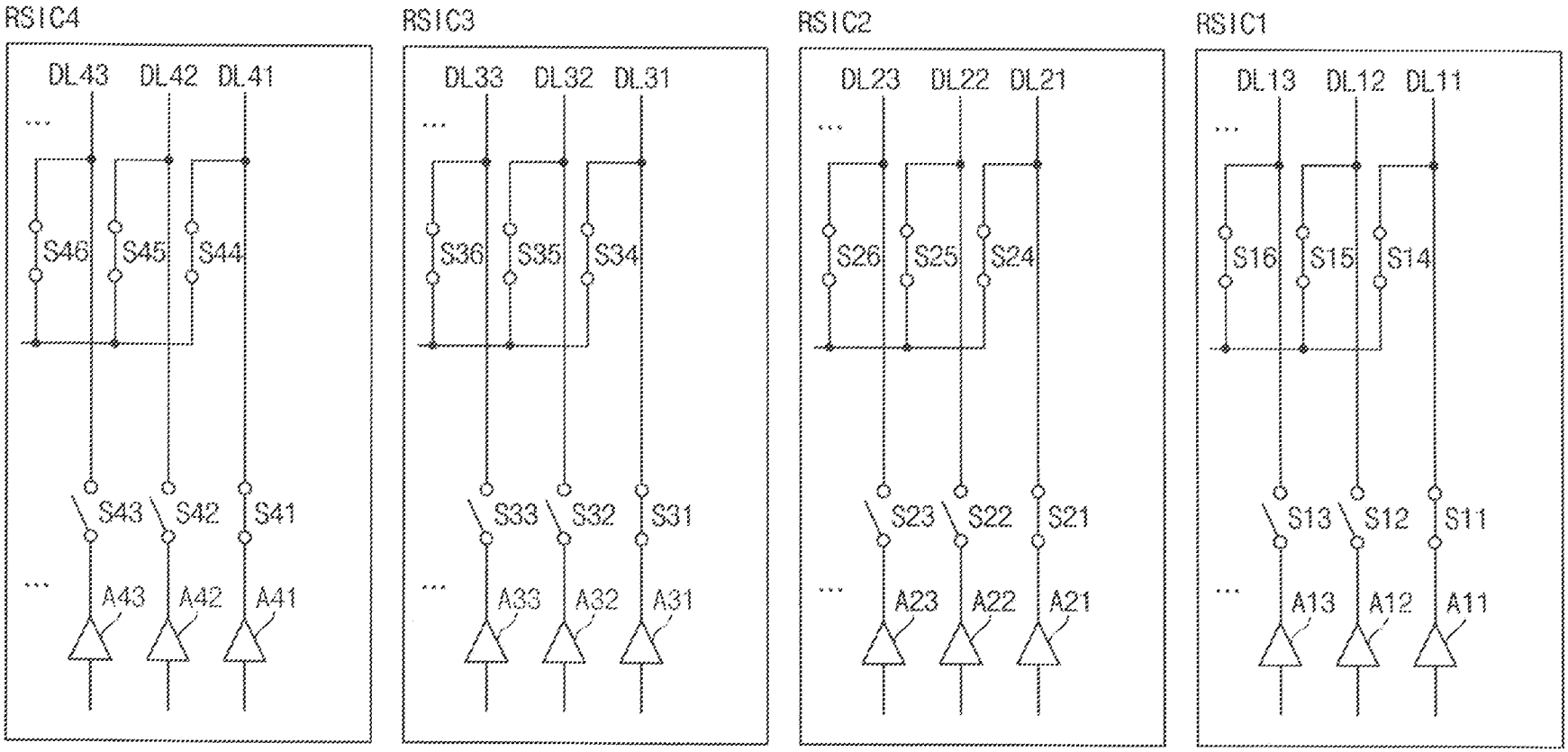
FIG. 8 is a circuit diagram illustrating readout chips of a display apparatus according to an embodiment of the present inventive concept.

FIG. 8 shows a circuit including readout chips of a display apparatus according to an embodiment of the present inventive concept.

The data driver and the display apparatus according to the present embodiment are substantially the same as the data driver and the display apparatus of the previous embodiment explained with reference to FIGS. 1 through 7 except that the sensing data voltage is output using only one output amplifier in each of the readout chips. Thus, the same reference numerals may be used to refer to the same or like parts as those described in the previous embodiment of FIGS. 1 through 7 and any repetitive explanation concerning the above elements may be omitted.

Referring to FIGS. 1 through 4 and 8, the display apparatus 10 includes a display panel 100 and a display panel driver. The display panel driver includes a driving controller 200, a gate driver 300, a gamma reference voltage generator 400 and a data driver 500.

The data driver 500 includes a plurality of amplifiers outputting the data voltages to the data lines. As shown in FIG. 8, each of the readout chips RSIC1, RSIC2, RSIC3 and RSIC4 may include the amplifiers outputting the data voltages to the data lines.

In a writing mode, the amplifiers of the data driver 500 may output the data voltages to the corresponding data lines. In the writing mode, the amplifiers and the data lines may be matched one-to-one.

In contrast, in the sensing mode, a single amplifier of the data driver 500 may output the sensing data voltage to the plurality of data lines. In the sensing mode, the amplifier and the data lines may be matched one-to-many.

In the present embodiment, for example, the sensing data voltage is applied to all of the data lines in each of the readout chips RSIC1, RSIC2, RSIC3 and RSIC4 using a single amplifier A11, A21, A31 and A41 in each of the readout chips RSIC1, RSIC2, RSIC3 and RSIC4.

Thus, the data driver of the present embodiment need not include the chip connecting lines CL1, CL2 and CL3, which connect between the readout chips RSIC1, RSIC2, RSIC3 and RSIC4, and the chip connecting switches S17, S27 and S37 connected to the chip connecting lines CL1, CL2 and CL3 which are shown in FIGS. 6 and 7.

According to the present embodiment, the sensing data voltage is output using only one output amplifier (e.g., A11, A21, A31 and A41) per single readout chip (e.g., RSIC1, RSIC2, RSIC3 and RSIC4) in the sensing mode so that the sensing error of the threshold voltage of the pixel P may be reduced.

Thus, a display defect due to the sensing error of the threshold voltage of the pixel P may be prevented and the display quality of the display panel may be optimized.

Figure 9:
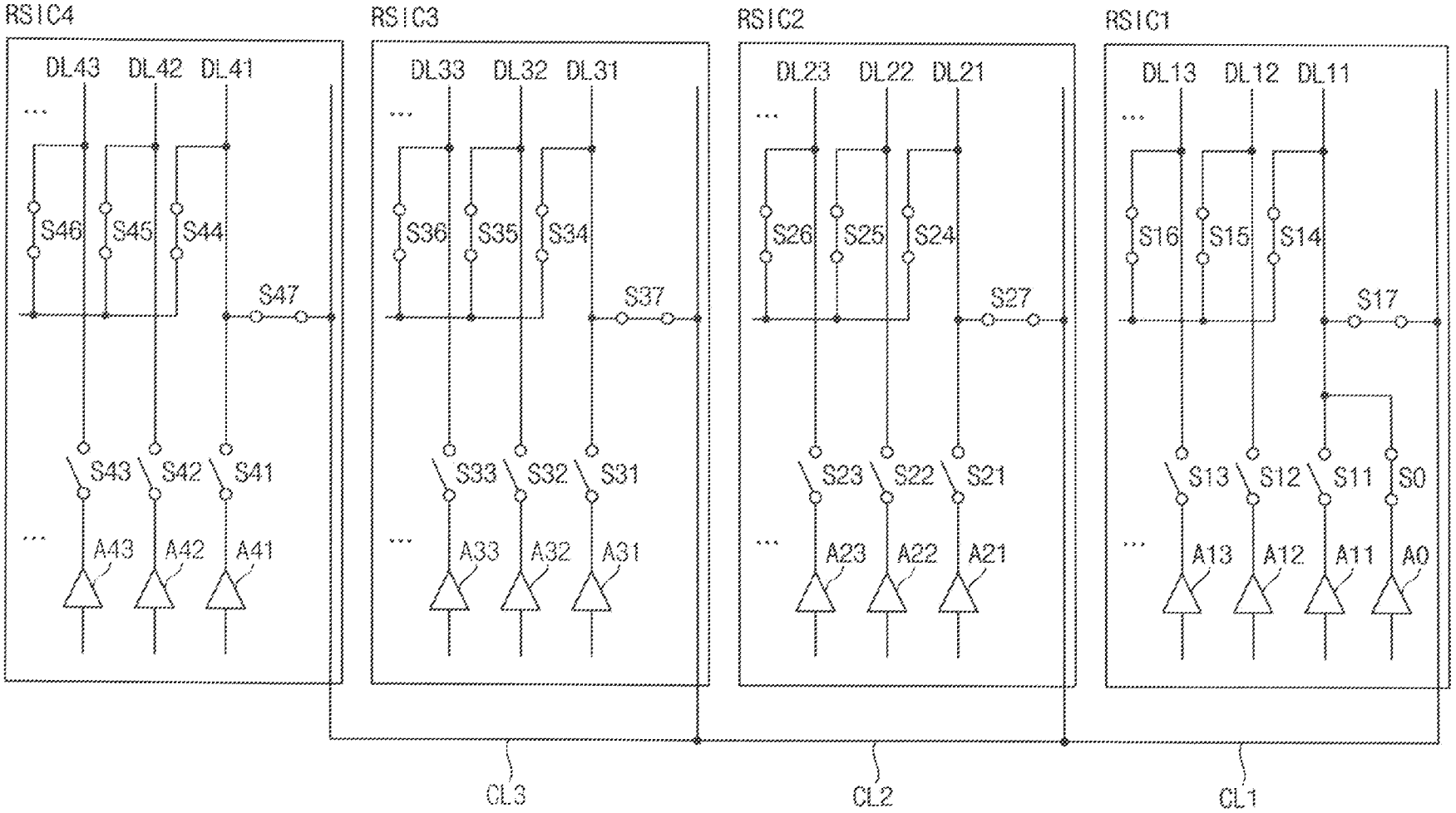
FIG. 9 is a circuit diagram illustrating readout chips of a display apparatus according to an embodiment of the present inventive concept.

FIG. 9 shows a circuit including readout chips of a display apparatus according to an embodiment of the present inventive concept.

The data driver and the display apparatus according to the present embodiment are substantially the same as the data driver and the display apparatus of the previous embodiment explained with reference to FIGS. 1 through 7 except that the first readout chip further includes a sensing amplifier and a sensing switch. Thus, the same reference numerals may be used to refer to the same or like parts as those described in the previous embodiment of FIGS. 1 through 7 and any repetitive explanation concerning the above elements may be omitted.

Referring to FIGS. 1 through 4 and 9, the display apparatus 10 includes a display panel 100 and a display panel driver. The display panel driver includes a driving controller 200, a gate driver 300, a gamma reference voltage generator 400 and a data driver 500.

The data driver 500 includes a plurality of amplifiers outputting the data voltages to the data lines. As shown in FIG. 9, each of the readout chips RSIC1, RSIC2, RSIC3 and RSIC4 may include the amplifiers outputting the data voltages to the data lines.

In a writing mode, the amplifiers of the data driver 500 may output the data voltages to the corresponding data lines. In the writing mode, the amplifiers and the data lines may be matched one-to-one.

In contrast, in the sensing mode, a single amplifier A0 of the data driver 500 may output the sensing data voltage to the plurality of data lines. In the sensing mode, the amplifier and the data lines may be matched one-to-many.

In the present embodiment, for example, the sensing data voltage is applied to all of the data lines corresponding to the four readout chips RSIC1, RSIC2, RSIC3 and RSIC4 using the single amplifier A0 of the data driver 500 in the sensing mode.

Alternatively, for example, the sensing data voltage may be applied to all of the data lines corresponding to eight readout chips disposed at the first printed circuit P1 and the second printed circuit P2 in FIG. 2 using the single amplifier A0 of the data driver 500.

In the present embodiment, the first readout chip RSIC1 may further include a sensing amplifier A0 and a sensing switch S0 connected to the sensing amplifier A0 and at least one (e.g., DL11) of the data lines.

In the writing mode, the first through third switches S11 through S13 may be turned on and the first through third channel connecting switches S14 through S16 and the sensing switch S0 may be turned off.

In the sensing mode, the first through third switches S11 through S13 may be turned off and the first through third channel connecting switches S14 through S16 and the sensing switch S0 may be turned on.

In the writing mode, the first readout chip RSIC1 may output the data voltages using the first through third amplifiers A11 through A13. In the sensing mode, the first readout chip RSIC1 may output the sensing data voltage to all of the data lines of the first readout chip RSIC1 using the sensing amplifier A0 which is formed independently from the first through third amplifiers A11 through A13.

In addition, the sensing data voltage of the sensing amplifier A0 of the first readout chip RSIC1 may be transmitted to the second readout chip RSIC2 through the chip connecting switch S17 and the first chip connecting line CL1.

Therefore, in the sensing mode, the sensing data voltage may be output to data lines DL21 through DL23 of the second readout chip RSIC2 by only the sensing amplifier A0.

In the same way, in the sensing mode, the sensing data voltage may be output to data lines DL31 through DL33 of the third readout chip RSIC3 and data lines DL41 through DL43 of the fourth readout chip RSIC4 by only the sensing amplifier A0.

According to the present embodiment, the sensing data voltage is output using only one output amplifier A0 in the plurality of readout chips RSIC1 through RSIC4 in the sensing mode so that the sensing error of the threshold voltage of the pixel P may be reduced.

Thus, the display defect due to the sensing error of the threshold voltage of the pixel P may be prevented and the display quality of the display panel may be optimized.

Figure 10:
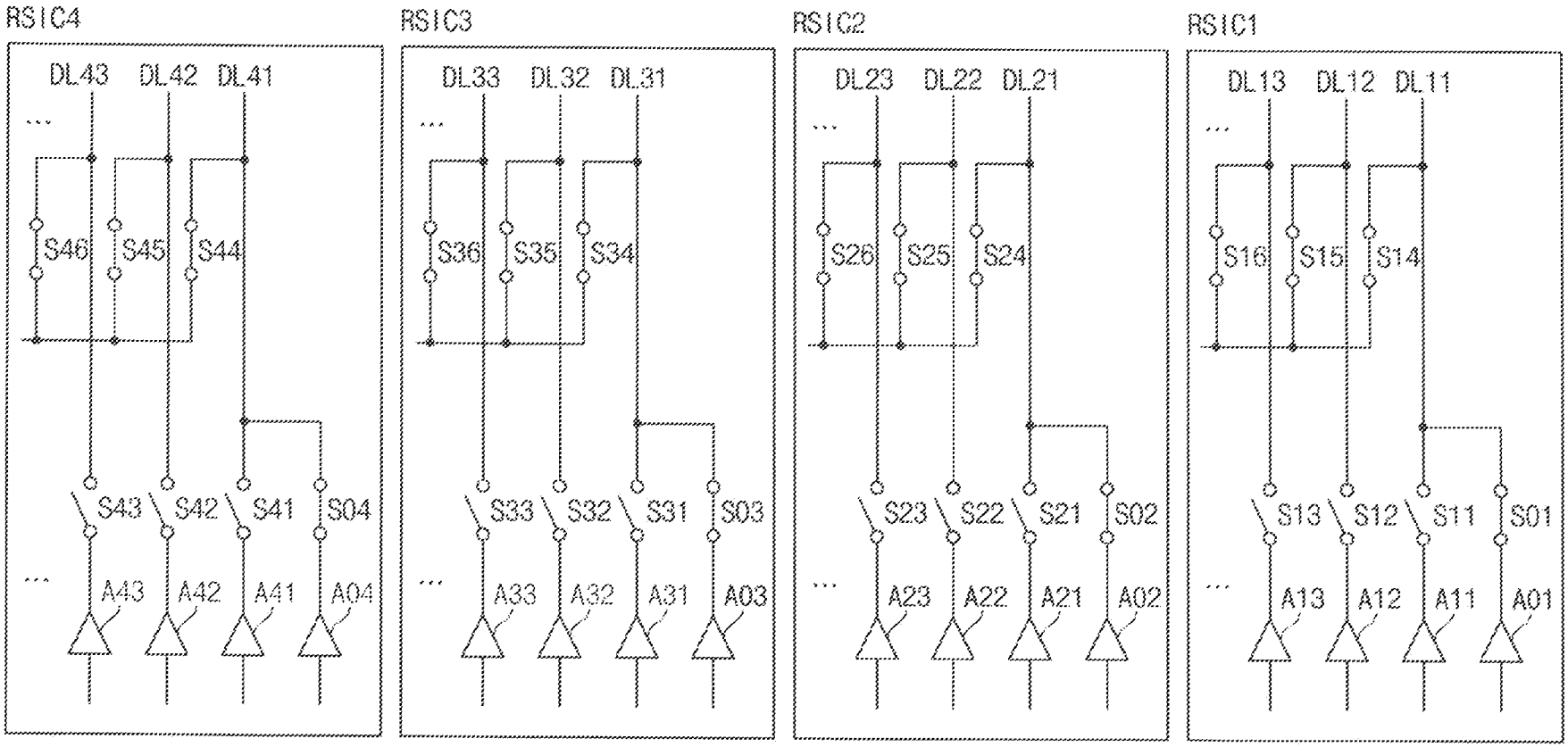
FIG. 10 is a circuit diagram illustrating readout chips of a display apparatus according to an embodiment of the present inventive concept.

FIG. 10 shows a circuit diagram including readout chips of a display apparatus according to an embodiment of the present inventive concept.

The data driver and the display apparatus according to the present embodiment are substantially the same as the data driver and the display apparatus of the previous embodiment explained with reference to FIG. 9 except that the sensing data voltage is output using only one output amplifier in each of the readout chips. Thus, the same reference numerals may be used to refer to the same or like parts as those described in the previous embodiment of FIG. 9 and any repetitive explanation concerning the above elements may be omitted.

Referring to FIGS. 1 through 4 and 10, the display apparatus 10 includes a display panel 100 and a display panel driver. The display panel driver includes a driving controller 200, a gate driver 300, a gamma reference voltage generator 400 and a data driver 500.

The data driver 500 includes a plurality of amplifiers outputting the data voltages to the data lines. As shown in FIG. 10, each of the readout chips RSIC1, RSIC2, RSIC3 and RSIC4 may include the amplifiers outputting the data voltages to the data lines.

In a writing mode, the amplifiers of the data driver 500 may output the data voltages to the corresponding data lines. In the writing mode, the amplifiers and the data lines may be matched one-to-one.

In contrast, in the sensing mode, a single amplifier of the data driver 500 may output the sensing data voltage to the plurality of data lines. In the sensing mode, the amplifier and the data lines may be matched one-to-many.

In the present embodiment, for example, each of the readout chips RSIC1, RSIC2, RSIC3 and RSIC4 may further include a sensing amplifier A01, A02, A03 and A04 and a sensing switch S01, S02, S03 and S04 connected to the sensing amplifier A01, A02, A03 and A04 and at least one (e.g., DL11, DL21, DL31 and DL41) of the data lines.

In the writing mode, the first through third switches S11 through S13 may be turned on and the first through third channel connecting switches S14 through S16 and the sensing switch S01 may be turned off.

In the sensing mode, the first through third switches S11 through S13 may be turned off and the first through third channel connecting switches S14 through S16 and the sensing switch S01 may be turned on.

In the writing mode, the first readout chip RSIC1 may output the data voltages using the first through third amplifiers A11 through A13. In the sensing mode, the first readout chip RSIC1 may output the sensing data voltage to all of the data lines of the first readout chip RSIC1 using the sensing amplifier A01 which is formed independently from the first through third amplifiers A11 through A13.

Similarly, in the sensing mode, the second through fourth readout chips RSIC2 through RSIC4 may output the sensing data voltage to all of the data lines of the second through fourth readout chips RSIC2 through RSIC4 using the sensing amplifiers A02, A03 and A04 which are formed independently from the data amplifiers.

According to the present embodiment, the sensing data voltage is output using only one output amplifier (e.g., A01, A02, A03 and A04) in each single readout chip (e.g., RSIC1, RSIC2, RSIC3 and RSIC4) in the sensing mode so that the sensing error of the threshold voltage of the pixel P may be reduced.

Thus, display defects due to the sensing error of the threshold voltage of the pixel P may be prevented and the display quality of the display panel may be optimized.

According to the present embodiment, the sensing error may be reduced so that the display quality of the display panel 100 may be optimized.

The foregoing is illustrative of the present inventive concept and is not to be construed as limiting thereof. Although some embodiments of the present inventive concept have been described, those of ordinary skill in the pertinent art will readily appreciate that many modifications are possible in the embodiments without materially departing from the teachings of the present inventive concept.

Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A data driver comprising a plurality of amplifiers configured to output a plurality of data voltages to a plurality of data lines, wherein the plurality of amplifiers are configured to output the plurality of data voltages to the corresponding plurality of data lines in a writing mode, and wherein only one of the plurality of amplifiers is configured to output a sensing data voltage to the plurality of data lines in a sensing mode.

2. The data driver of claim 1, further comprising:

a first amplifier connected to a first data line;

a switch connected between a second amplifier and a second data line; and at least one channel-connecting switch disposed at a connecting path between the first data line and the second data line, wherein the plurality of amplifiers is substantially equal to the plurality of data lines.

3. The data driver of claim 2, wherein the at least one channel-connecting switch comprises:

a first channel-connecting switch connected between the first data line and a common node; and a second channel-connecting switch connected between the second data line and the common node.

4. The data driver of claim 3, wherein the switch is turned on and the first channel-connecting switch and the second channel connecting switch are turned off in the writing mode, and wherein the switch is turned off and the first channel-connecting switch and the second channel-connecting switch are turned on in the sensing mode.

5. The data driver of claim 3, wherein the data driver comprises a plurality of readout chips, wherein the switch, the first channel-connecting switch and the second channel-connecting switch are disposed in a first readout chip, and wherein the data driver further comprises a first chip-connecting line connecting the first readout chip with a second readout chip, and a chip-connecting switch connected between the first chip-connecting line and at least one of the data lines.

6. The data driver of claim 5, wherein the switch is turned on, and the first channel-connecting switch, the second channel-connecting switch and the chip-connecting switch are turned off in the writing mode, and wherein the switch is turned off, and the first channel-connecting switch, the second channel-connecting switch and the chip-connecting switch are turned on in the sensing mode.

7. The data driver of claim 3 wherein the switch is a second switch, further comprising:

a first switch connected between the first amplifier and the first data line a sensing amplifier and a sensing switch connected between the sensing amplifier and at least one of the data lines.

8. The data driver of claim 7, wherein the first switch and the second switch are turned on, and the first channel-connecting switch, the second channel-connecting switch and the sensing switch are turned off in the writing mode, and wherein the first switch and the second switch are turned off, and the first channel-connecting switch, the second channel-connecting switch and the sensing switch are turned on in the sensing mode.

9. The data driver of claim 3, further comprising a first switch connected between the first amplifier and the first data line, wherein the switch is a second switch, wherein the data driver comprises a plurality of readout chips, wherein the first switch, the second switch, the first channel-connecting switch and the second channel-connecting switch are disposed in a first readout chip, and wherein the data driver further comprises a first chip-connecting line connecting the first readout chip with a second readout chip, a chip-connecting switch connected between the first chip-connecting line and at least one of the data lines, a sensing amplifier and a sensing switch connected between the sensing amplifier and at least one of the data lines.

10. The data driver of claim 9, wherein the first switch and the second switch are turned on, and the first channel-connecting switch, the second channel-connecting switch and the chip-connecting switch and the sensing switch are turned off in the writing mode, and wherein the first switch and the second switch are turned off, the first channel-connecting switch, the second channel-connecting switch, the chip-connecting switch and the sensing switch are turned on in the sensing mode.

11. A display apparatus comprising:

a display panel configured to display an image based on input image data, the display panel comprising a plurality of data lines and a plurality of pixels connected to the plurality of data lines; and a data driver comprising a plurality of amplifiers configured to output data voltages to the plurality of data lines, wherein the plurality of amplifiers are configured to output the data voltages to the corresponding plurality of data lines in a writing mode, and wherein only one of the plurality of amplifiers is configured to output a sensing data voltage to the plurality of data lines in a sensing mode.

12. The display apparatus of claim 11, wherein the plurality of amplifiers is substantially equal to the plurality of data lines, and at least one of the plurality of pixels comprises:

a first thin-film transistor configured to apply a first power voltage to a second node in response to a signal at a first node;

a second thin-film transistor configured to output the data voltage to the first node in response to a first signal;

a third thin-film transistor configured to output a signal at the second node to a sensing node in response to a second signal;

a storage capacitor comprising a first end portion connected to the first node and a second end portion connected to the second node; and a light-emitting element comprising a first electrode connected to the second node and a second electrode configured to receive a second power voltage.

13. The display apparatus of claim 12, wherein the data driver further comprises:

a first amplifier connected to a first data line of the plurality of data lines;

a switch connected between a second amplifier and a second data line of the plurality of data lines; and at least one channel-connecting switch disposed at a connecting path between the first data line and the second data line.

14. The display apparatus of claim 13, wherein the at least one channel-connecting switch comprises:

a first channel-connecting switch connected between the first data line and a common node; and a second channel-connecting switch connected between the second data line and the common node.

15. The display apparatus of claim 14, wherein the data driver comprises a plurality of readout chips, wherein the switch, the first channel-connecting switch and the second channel-connecting switch are disposed in a first readout chip, and wherein the data driver further comprises a first chip-connecting line connecting the first readout chip with a second readout chip, and a chip-connecting switch connected between the first chip connecting line and at least one of the plurality of data lines.

16. The display apparatus of claim 14, wherein the data driver further comprises a sensing amplifier and a sensing switch connected between the sensing amplifier and at least one of the plurality of data lines.

17. The display apparatus of claim 14, wherein the data driver comprises a plurality of readout chips, wherein the switch, the first channel-connecting switch and the second channel-connecting switch are disposed in a first readout chip of the plurality of readout chips, and wherein the data driver further comprises a first chip-connecting line connecting the first readout chip and a second readout chip of the plurality of readout chips, a chip-connecting switch connected between the first chip-connecting line and at least one of the plurality of data lines, a sensing amplifier and a sensing switch connected between the sensing amplifier and at least one of the plurality of data lines.

18. A method of sensing a threshold voltage of a pixel, the method comprising:

outputting a plurality of data voltages to a plurality of corresponding data lines connected to a plurality of pixels using a plurality of amplifiers in a writing mode;

outputting a sensing data voltage to the plurality of data lines using only one of the plurality of amplifiers in a sensing mode; and receiving a sensing signal using a plurality of sensing lines connected to the plurality of pixels in the sensing mode.

19. The method of claim 18, wherein the plurality of amplifiers is substantially equal to the plurality of data lines, a first amplifier is connected to a first data line, and a switch connected between a second amplifier and a second data line is turned on, and a channel-connecting switch connected between the first data line and the second data line is turned off, in the writing mode.

20. The method of claim 19, wherein the switch is turned off and the channel-connecting switch is turned on in the sensing mode.

* * * * *